US011107343B2

(12) United States Patent
Frost et al.

(10) Patent No.: US 11,107,343 B2
(45) Date of Patent: Aug. 31, 2021

(54) SYSTEM AND METHOD OF USER MOBILITY MONITORING

(71) Applicant: Curamicus Ltd., Bournemouth (GB)

(72) Inventors: Robin Frost, Bournemouth (GB); Susan Frost, Bournemouth (GB)

(73) Assignees: Curamicus Ltd., Polegate East Sussex (GB); Robin Frost, Poole (GB); Susan Frost, Poole (GB)

( * ) Notice: Subject to any disclaimer, the term of this patent is extended or adjusted under 35 U.S.C. 154(b) by 0 days.

(21) Appl. No.: 16/461,997

(22) PCT Filed: Nov. 23, 2017

(86) PCT No.: PCT/GB2017/053525
§ 371 (c)(1),
(2) Date: May 17, 2019

(87) PCT Pub. No.: WO2018/096337
PCT Pub. Date: May 31, 2018

(65) Prior Publication Data

US 2019/0325729 A1 Oct. 24, 2019

(30) Foreign Application Priority Data

Nov. 23, 2016 (GB) ..... 1619800

(51) Int. Cl.
*G08B 21/04* (2006.01)
*G08B 25/08* (2006.01)

(52) U.S. Cl.
CPC ..... *G08B 21/0446* (2013.01); *G08B 21/0453* (2013.01); *G08B 25/08* (2013.01)

(58) Field of Classification Search
CPC ... A61B 5/0022; A61B 5/0205; A61B 5/1118; G06F 19/3418; G16H 40/67; G08B 21/0446; G08B 21/0453; G08B 25/08
See application file for complete search history.

(56) References Cited

U.S. PATENT DOCUMENTS

2011/0025493 A1 2/2011 Papadopoulos
2012/0242501 A1* 9/2012 Tran ..... A61B 5/0024 340/870.02

(Continued)

FOREIGN PATENT DOCUMENTS

EP 1 421 896 5/2004

OTHER PUBLICATIONS

International Search Report, PCT/GB2017/053525, dated Feb. 23, 2018.

*Primary Examiner* — Orlando Bousono
(74) *Attorney, Agent, or Firm* — Andrus Intellectual Property Law, LLP

(57) ABSTRACT

A user mobility monitoring system has a user-wearable device and a remote analysis system. The user-wearable device monitors the physical mobility of a user, having a plurality of sensors, including at least motion sensors, the device being wirelessly connectable to the Internet and adapted in use to transmit wirelessly to the Internet real-time sensor data from the sensors for the duration of a monitoring period. The remote analysis system is connectable to the Internet and adapted in use to receive the sensor data transmitted via the Internet from the user-wearable device and, during the monitoring period, to analyse the data so as to detect a physical instability event of the user and generate corresponding alert data. An analogous method of monitoring the mobility of a user is also provided. The operation of the user-wearable device is controlled at least partly by the remote analysis system.

16 Claims, 4 Drawing Sheets

(56) References Cited

U.S. PATENT DOCUMENTS

| | | | | |
|---|---|---|---|---|
| 2013/0069780 | A1* | 3/2013 | Tran | A61B 5/0024 340/539.12 |
| 2013/0172691 | A1 | 7/2013 | Tran | |
| 2013/0178718 | A1* | 7/2013 | Tran | A61B 5/0024 600/301 |
| 2014/0055284 | A1* | 2/2014 | Tran | A61B 5/0024 340/870.07 |
| 2014/0121476 | A1* | 5/2014 | Tran | A61B 5/0024 600/301 |
| 2015/0105631 | A1* | 4/2015 | Tran | A61B 5/0024 600/301 |
| 2015/0161876 | A1 | 6/2015 | Castillo | |
| 2015/0182843 | A1* | 7/2015 | Esposito | G06K 9/00342 700/91 |
| 2016/0066788 | A1* | 3/2016 | Tran | A61B 5/0024 340/870.07 |
| 2016/0171864 | A1* | 6/2016 | Ciaramelletti | A42B 3/046 340/539.12 |
| 2016/0210838 | A1 | 7/2016 | Yan et al. | |
| 2016/0287166 | A1* | 10/2016 | Tran | H04W 4/80 |
| 2017/0005958 | A1* | 1/2017 | Frenkel | H04W 4/90 |
| 2017/0148297 | A1* | 5/2017 | Ross | G08B 21/043 |

* cited by examiner

SYSTEM AND METHOD OF USER MOBILITY MONITORING

CROSS-REFERENCE TO RELATED APPLICATIONS

This application is the U.S. national stage application of International Application PCT/GB2017/053525, filed Nov. 23, 2017, which international application was published on May 31, 2018, as International Publication WO 2018/096337 in the English language. The International Application claims priority of British Patent Application No. 1619800.4, filed Nov. 23, 2016. The international application and British application are both incorporated herein by reference, in entirety.

FIELD OF THE INVENTION

The present invention relates to a user mobility monitoring system, together with a method of monitoring the mobility of a user.

BACKGROUND TO THE INVENTION

As standards of living rise across the globe and medical technology improves there are increasing numbers of people who require some degree of care during their daily lives. This is primarily due to an aging population although similar issues apply to younger people with disabilities or medium to long term medical conditions. It is desirable for such people to remain in their homes and communities since this has a positive effect on their well-being. In a hospital environment or a care home, systems and staff exist to regularly check on residents. If people remain in their homes then, particularly in westernised society where fewer family members live in each household, a significant problem exists in ensuring the safety of such vulnerable people. One approach to address this is to arrange carers to contact or visit the vulnerable person a number of times a day (analogous to the hospital or care home approach). In many situations this is impractical and costly. Even with such an approach a vulnerable person who suffers some form of medical emergency or accident could be without help for a number of hours. Often such vulnerable people wish to be independent and do not always welcome regular "checking up" by others. Furthermore, vulnerable people often do not wish to "burden" others with their care and therefore may conceal their need for help.

A number of relatively low technology approaches to address these issues have been available for some time. These are known generally as Medical Alert Systems. Typically such systems have a pendant which is worn around the neck of the user. This pendant has a 'red button' to press if a fall or other emergency occurs and the wearer is still conscious. These employ low-frequency radio (433 MHz and 890 MHz) bands to transmit only the button press event to an analogue phone base station.

These radio frequency bands have sub-bands allocated for use by personal alarm systems. The technology is about 30 years old. The transmissions from the pendants are not reliable, so the pendant will send the transmission three times expecting that one will get through. Furthermore these radio bands cannot be used to provide more advanced communications as they have severe restrictions (mandated by government regulations) on the duty cycle of transmitters. These restrictions are incorporated into the radio chips and cannot be overridden.

On receipt of a pendant's radio transmission the phone base station will make a call to a call centre over an analogue phone line. An operative at the call centre will attempt to shout to the person from the base station's speaker (if in audio range) and wait if they can hear (via the base station's microphone) whether that person is okay. Otherwise they will call the emergency services.

Some developments of this system have been proposed. For example versions of the pendant system exist where a simple accelerometer is added into the pendant. The accelerometer responds only to a simple shock, in a similar manner to a hard disk drop protector. Whilst these do provide a degree of improvement over pendants alone, due to their simple approach these accelerometer-fitter pendants are plagued by false positives.

There exists a widespread and significant need for a new approach which addresses each of these issues. In particular there is needed a system which enables users to lead independent lives, without unnecessary carer interventions, and which can accurately identify when a user is in need of assistance.

SUMMARY OF THE INVENTION

In accordance with a first aspect of the present invention, we provide a user mobility monitoring system comprising: a user-wearable device for monitoring the physical mobility of a user, the user-wearable device having a plurality of sensors, including at least motion sensors, the device being wirelessly connectable to the Internet and adapted in use to transmit wirelessly to the Internet real-time sensor data from the sensors for the duration of a monitoring period; and, a remote analysis system connectable to the Internet and adapted in use to receive the sensor data transmitted via the Internet from the user-wearable device and, during the monitoring period, to analyse the data so as to detect a physical instability event of the user and generate corresponding alert data, wherein the operation of the user-wearable device is controlled at least partly by the remote analysis system.

The present invention provides a significant advance over known techniques in its ability to deliver high quality rapid and responsive mobility monitoring of a user. The sensors are able to provide much more accurate data relating to the mobility of the user than known systems. Furthermore this data can be analysed fully due to the availability of the processing power of a remote system. In particular the system uses a remote system to analyse this data which means that the design of the user-wearable device can be focused upon the sensors and any user interactive functions. This enables a compact design to be effected, for example for wearing at the waist of the user. The remote analysis system enables the processing resources applicable to the data to be effectively unlimited and not constrained by the physical or power limitations of a user-wearable device. This remote processing capability allows processing-intensive algorithms to be applied to the data from the sensors thereby enabling an unprecedented degree of analysis to be performed upon the data. As a result the invention makes it possible to reliably detect user instability events and even to categorise them into different event types as soon as they occur. The provision of a reliable and accurate monitoring system gives the carers and users alike the reassurances that they need to enable the users to live independent lives in their communities.

A critical advantage that arises from the invention is that the sensors and instability event detection is sufficiently accurate such that the interaction of the user with the system is not essential to enable its practical use since the number of false positives generated in comparison with known systems is dramatically reduced. This also means that the system can be used to monitor users for whom prior art systems are unsuitable, that is, those who face significant personal challenges in terms of coordination or speech. Such users are now more likely to be able to remain within their homes, supported by a combination of the present system and by frequent daily support visits from carers. Between carer visits such vulnerable users may be very effectively monitored and the remote analysis system algorithms adjusted to provide high sensitivity instability event detection.

As the operation of the user-wearable device is controlled at least partly by the remote analysis system, the remote analysis system may cause the user-wearable device to operate in appropriate operating modes without requiring calculation or input from the user or the device. This provides a system in which the operation of the device can be continuously updated at a remote location to provide suitable detection ability while removing the need for the user to update the device settings or for the device to perform burdensome processing in relation to its circumstances.

The "off-device" processing of the sensor data allows much greater choice between the number and type of sensors. Typically the user-wearable device includes a sensor subsystem comprising the plurality of sensors, wherein the plurality of sensors include motion, position and environmental sensors. The motion sensors preferably are provided to detect rotational as well as linear motion upon each of three orthogonal axes. The position sensors provide valuable additional information regarding the orientation and possibly location (within a monitored area) of the user. Such position sensors may also include high resolution altitude sensing to allow the difference in height between a standing person and a lying person to be detected. The environmental monitoring may include temperature monitoring of the ambient environment. Very high temperature environments or very low temperature environments each represent threats to life for example. Other environmental sensing may include that of ambient light or other factors such as humidity. Data from each of these environmental sensors can be used to feed into the decision making of the remote analysis system, together with any prioritising of action resulting from such decisions. Thus preferably the sensors include one or more types of sensors selected from the list of: accelerometers, gyroscopic sensors, barometric sensors, light sensors, temperature sensors, compasses.

The user-wearable device typically comprises a user interaction subsystem having one or more devices selected from the list of: a display, a buzzer, a haptic transducer (an example being a vibration feedback transducer such as is found in a smartphone, producing a vibration to bring attention to the user), a touch controller. It is important to design any user interfaces with the capabilities of the user in mind, particularly under different instability event circumstances. Thus it is preferred that more than one method is used for providing information to and in particular, receiving information from, the user (for example by pressing a button, swiping a contact, shaking or tapping the device, or speaking to it).

The user-wearable device may also comprise a sound subsystem including a speaker. This can be used to play alert sounds (such as a waking alarm) or to convey spoken messages from the remote analysis system or from carers. Preferably the speaker generates a sufficiently low level (including none) of electromagnetic radiation to have substantially no effect upon the sensors.

It is important that the user-wearable device is provided with a robust and reliable power supply. Since the user-wearable device will in almost all cases be required to be entirely portable then such a power supply is generally needed to supply all of the functions of the device autonomously for a number of hours normal use (such as 24 hours for example) without external charging. In addition it is desirable that the power supply capability is able to continue to operate after a period of extended use beyond the normal use period (for example beyond 48 hours) in the event of unpredictable events occurring (extreme weather, power outages, infrastructure problems and so on). It is preferred that the user-wearable device comprises a power subsystem comprising a rechargeable battery and an inductive coupling charger. Such a charger provides advantages in terms of simplicity of operation, normally a fixed location of use and ease of use.

The manner in which the user-wearable device communicates with the remote analysis system is central to the success of the system. The user-wearable device preferably comprises a communication and application subsystem adapted to provide direct communication using the Wi-Fi protocol to an Internet-connected router. It will be understood that a direct, fast Wi-Fi connection is much more efficient than relaying data through a smartphone via, for example, Bluetooth. With the use of Wi-Fi the device may also connect directly to local Wi-Fi hotspots that it encounters, rather than being tied to a phone that is battery operated and that can run out of power, leaving the device out of contact.

The use of Wi-Fi is contrary to approaches adopted by manufacturers in the fitness tracking market which have proposed wearable devices that either employ Bluetooth Low Energy (also called Bluetooth Smart) to connect to a smartphone or low-frequency radio. In such systems the smartphone is then used as a router to the internet through Wi-Fi or via the mobile telephone network.

Bluetooth is not a reliable solution for the present field of user mobility monitoring for instability detection. Its disadvantages include:

1) the need for an in-range charged/operational smartphone;

2) pairing is required and this is lost quite frequently;

3) there is a much smaller real-world range for Bluetooth than quoted by manufacturers;

4) there are no booster possibilities available for Bluetooth to get around signal blockage by building infrastructure (e.g. steel beams or columns);

5) it is not reliable over a period of hours/days, often losing the connection and requiring re-connecting/re-pairing to continue.

Fundamentally, the latency involved in passing all data through a smartphone would be insufficient for a real-time sensor data monitoring system.

The preferred Wi-Fi approach of the present invention provides numerous key advantages in terms of connectivity, reliability, bandwidth, data transmission range (including with boosters and extenders) and fundamental speed.

Recent developments in electronics mean that some of the user-wearable device subsystems can be incorporated together. Preferably therefore the communication and application subsystem is effected using a "system on chip" or "system on module" design with integrated application processor and Wi-Fi hardware.

One of the significant advantages of the system is the use of processing which is remote from the user. This may be effected using servers and other hardware using traditional system architectures. However, the invention lends itself particularly to the use of "cloud" computing. A number of different types of cloud services are now well established (including those denoted "software", "platform" and "infrastructure"). The potentially worldwide distribution of the users and their potential number means that cloud services are highly suited for use in implementing the system, particularly due to the ease with which the system may be scaled. Thus the remote analysis system is preferably effected using one or more cloud computing service models.

The remote analysis system is typically computer-implemented in software and it will be appreciated that, since it has a number of functions, the remote analysis system can be thought of as various interconnected subsystems in terms of the architecture. It will be understood that various different approaches may be adopted in terms of this architecture so as to deliver a particular implementation of the system.

The remote analysis system is Internet-connected when in use and therefore typically the remote analysis system continuously analyses the sensor data which is streamed from the user-wearable device during the monitoring period.

In practice the analysis is continuous in the sense that there is no period longer than a fraction of one second (preferably not longer than 0.1 seconds), for which sensor data is not analysed. Thus the data stream which is analysed is effectively uninterrupted. This monitoring of a continuous data stream is therefore part of the concept of processing real-time sensor data.

The time delay between the acquisition of sensor data and the initiation of analysis of the data by the remote analysis system is less than a fraction of a second (preferably no longer than 0.1 seconds). Thus, the analysis of the sensor data by the remote analysis system is effectively in real-time.

The monitoring of the user mobility is current or live in the sense that the communication to and from the remote analysis system, together with the analysis performed by the remote analysis system in order to make a decision, incurs no significant delay from the perspective of the user who experiences a fall or some other instability event. In practice this is preferably effected by the remote analysis system being capable throughout the monitoring period of generating alert data within 30 seconds (more preferably 15 seconds) of a user instability event occurring. The sensor data is effectively transmitted instantaneously can continuously on this timescale. It will be understood that an instability event itself may have a duration of one or more seconds. A benefit of the system is that the alert data may be generated and the user may be contacted by the system within a few seconds of the event such that the user receives immediate reassurance. The system will continue to monitor the user immediately after the instability event occurring and may then take the further data received into account prior to deciding on the action(s) to take.

The system may be configured to monitor for different types of user instability events. The most significant event is that of a fall and therefore fall detection is a preferred feature of the processing of the remote analysis system. However, other sorts of user instability events may be monitored including partials falls to a stooped (arm supported) or kneeling position, stumbles and trips (each with or without associated impacts), together with uncontrolled adoption of a seating position.

A key advantage of the system is the ability of the remote analysis system to perform sophisticated analysis of the sensor data. It is preferred that the analysis is performed by processing the sensor data with one or more artificial intelligence (AI) algorithms. A large number of such algorithms are known including algorithms that decipher complex patterns within multiple parameter data and those that learn behaviours from data. For example TensorFlow from Google provides a suit of open source algorithms which may be used to implement the invention.

With a large number of sensors and high sensing rates (such as in excess of 400 Hz) the data stream for processing by the remote analysis system can become large. In order to address this, it is preferred that the user-wearable device is adapted such that the said real-time sensor data is transmitted as a first data set and wherein a second data set, corresponding to the first data set, is stored locally on the user-wearable device (for example in a short term memory or cache) and is transmitted to the analysis system as a result of a request received from the analysis system. Typically the second data set comprises one or each of, data at a greater time sampling rate than that of the first data set, or data from additional sensors to that present in the first data set. Each of these alternatives reduces the size of the data stream of the first data set and the corresponding processing required by the remote analysis system. Any sensor data not used in the first data stream should of course have no significant effect on the outcome of decision making by the remote analysis system. Typically the first data stream contains data sampled at 50 to 100 Hz whereas some sensors may actually output data at 400 to 1000 Hz. The complete data at these higher rates may therefore be included only in the second data set.

As will be understood, any particular user may not undergo an instability event for many consecutive hours, days or weeks. For this reason it is advantageous that the second data set represents data obtained during a part (a fraction) of the monitoring period, most advantageously for the few relevant seconds (such as 5 to 10 seconds, optionally up to 30 seconds) related to an instability event. This may be effected whereby the remote analysis system is adapted to process the first data set and, upon detection of a provisional physical instability event, request the second data set from the device and further process the second data set so as to confirm whether the provisional physical instability event is a physical instability event.

In the remote analysis system, the monitoring of the first data set is preferably performed by a stream processing subsystem. With the use of this subsystem, when the monitoring is performed upon the first data set and the monitoring provisionally indicates that an instability event has occurred, then the remote analysis system typically sends a request to the user-wearable device to transmit the second data set representative of the part of the monitoring period for which the provisional indication has occurred, to the remote analysis system. The remote analysis system is also preferably provided with a machine reasoning subsystem which then analyses the second data set to monitor whether a user instability even has occurred and, if such an event has occurred, then the alert data is generated.

Each user will have a unique set of personal mobility challenges and will also have a unique daily routine, particularly dependent upon where and how they live. This means that a unique pattern of mobility data will be obtained from the sensors for each user. A key preferred feature of the system is the ability to learn the patterns of behaviour for the particular monitored user which can significantly increase the accuracy of the decision making around instability events. The remote analysis system therefore preferably comprises a machine learning subsystem which analyses previously obtained sensor data from the user, representing previous mobility activity of the user over a historical period, and wherein the remote analysis system uses the results of the analysis by the machine learning subsystem in the monitoring for user instability events. The historical period may be a period of days, weeks or months for example, depending somewhat upon the stability of any medical conditions of the user.

The storage of such data over a significant period provides the possibility for other beneficial monitoring functions. The remote analysis system may be further adapted to store the sensor data and to analyse the sensor data representing the mobility activity of the user which has occurred during a trend period at least greater than the monitoring period so as to generate trend data representing trends in the mobility activity of the user. Whereas the above machine learning subsystem is directed at using historical data to improve the recognition of patterns of behaviour, the departure from which may indicate an instability event, in the case of trend analysis the system is focused on trends in the data. The trend data may be indicative of either the improvement or worsening of the mobility of the user. Such trends can then be advised to carers or physicians.

The remote analysis system preferably not only makes decisions regarding whether an event has occurred in terms of alert data but also takes further action in organising a response. Advantageously therefore, the remote analysis system may further comprise a communications hub which is adapted to communicate an alert message to one or more recipients in response to the alert data being generated. Such alert messages may include a number of different approaches including emails, SMS text alerts, social media messages or a telephone voice message.

It is further preferred that the remote analysis system, preferably the communications hub, is able to receive and process messages from recipients (such as the user or carers). In the case of messages received electronically as text characters the remote analysis system is preferably further adapted to receive a textual message from a predefined source, to convert the textual message into a voice data file and then transmit the voice data file to the user-wearable device for audible transmission to the user. This provides reassurance to the user in the event that they are unable to see or read any displayed information on the user-wearable device.

As an additional benefit of the system, there may be provided a computer-implemented dashboard which is adapted to provide information about the user to a carer or other recipients (such as a physician). The information provided may be entirely configurable and may include present user status information and recent messages sent and received between the user, the recipient and the remote analysis system. Furthermore, communications between other recipients and the user may be viewable to give a fuller picture of recent events to each carer. In addition, trend information and statistics concerning the user's mobility, their daily activity patterns and any provisional or confirmed instability events, may be presented. Such a dashboard may be accessible via a web address with an appropriate login. Alternatively a suitable app may be provided on a smartphone. Through the dashboard, or otherwise, once carers and other recipients have visited the user, they may advantageously provide feedback data to the remote analysis system indicating the nature of the instability event that the user suffered, this data being extremely beneficial to future "learning" of the system. The data regarding falls and other instability events may be used in improving the detection capabilities of the system, not only for the specific user in question, but also system-wide for many other users.

The invention includes a remote analysis system for use in the user mobility monitoring system of the first aspect of the invention or for performing a method in accordance with a second aspect to be described. The remote analysis system is generally computer-implemented on one or more processors at a location remote from that of the user-wearable device and is further adapted to communicate via the Internet with the user-wearable device of the user mobility monitoring system.

The invention also includes a user-wearable device for use in the user mobility monitoring system of the first aspect of the invention or for performing a method in accordance with a second aspect to be described. The user-wearable device is adapted to communicate via the Internet with the remote analysis system of the user mobility monitoring system.

In some examples, the user mobility monitoring system comprises an internet enabled lighting control module configured to control at least one light in a building, wherein the remote analysis system is configured to send, upon detecting an instability event of the user, a command to the internet enabled lighting control module causing the at least one light to turn on.

In some examples, the user mobility monitoring system comprises an internet enabled display device external to the user-wearable device, wherein the remote analysis system is configured to send, upon detecting an instability event of the user, a command to the internet enabled display device causing the internet enabled display device to display a textual message for the user.

In some examples, the user mobility monitoring system comprises a secondary user-wearable device for monitoring the physical mobility of a user, the secondary user-wearable device having a plurality of sensors, including at least motion sensors, wherein the secondary user-wearable device is either wirelessly connectable to the Internet or wirelessly connectable to the user-wearable device, and wherein the secondary user-wearable device is adapted in use to transmit wirelessly to the Internet or the user-wearable device real-time sensor data from the sensors for the duration of a second monitoring period; and, wherein the remote analysis system is adapted in use to receive the sensor data transmitted via the Internet from the secondary user-wearable device and, during the second monitoring period, to analyse the data so as to detect a physical instability event of the user and generate corresponding alert data, wherein the operation of the secondary user-wearable device is controlled at least partly by the remote analysis system.

In some examples, in response to the remote analysis system detecting that the user-wearable device is no longer able to detect motion of the user and that the secondary user-wearable device is able to detect motion of the user, the remote analysis system commands the user-wearable device to cease transmitting real-time sensor data to the remote analysis system, and the remote analysis system commands the secondary user-wearable device to begin transmitting real-time sensor data to the remote analysis system.

In accordance with a second aspect of the invention we provide a method of monitoring the mobility of a user who is wearing a user-wearable device which has a plurality of sensors, including at least motion sensors, the device being connected to a remote analysis system via a wireless connection to the Internet, the method comprising: transmitting sensor data from the sensors of the user-wearable device, in real-time, to the remote analysis system via the Internet, for the duration of a monitoring period; receiving the transmitted sensor data at the remote analysis system; and, analysing the transmitted sensor data at the remote analysis system so as to detect a physical instability event of the user; and, generating alert data by the remote analysis system if a physical instability event of the user is detected.

Thus there is provided a method of monitoring the mobility of a user in a rapid, live and responsive timeframe. Typically such a method is effected using the system according to the first aspect of the invention.

The said real-time sensor data is generally transmitted as a first data set and wherein, upon receipt by the user-wearable device of a request from the remote analysis system, a second data set, corresponding to the first data set and stored locally on the user-wearable device, is transmitted to the remote analysis system. One or each of the first and second data sets may be streamed from the user-wearable device to the remote analysis system. Streaming is particularly important for real time analysis in the case of the first data set. The second data set typically comprises one or each of, data at a greater time sampling rate than that of the first data set, or data from additional sensors to that present in the first data set. Normally the second data set represents data obtained during an immediately preceding part of the monitoring period (typically the most recent few seconds of data, such as 5 to 10 seconds) such that the second data set represents a dynamically changing part of the first data set as the first data set is generated by the sensors.

The step of analysing the transmitted sensor data at the remote analysis system generally comprises analysing the first set of data for the existence of a provisional physical instability event and, upon detection of a provisional physical instability event, requesting the second set of data from the device and further analysing the second set of data so as to confirm whether the provisional physical instability event is a physical instability event. Appropriate action may then be taken according to the method.

It is preferred that the method is effected using a Wi-Fi connection between the user-wearable device and a router connected to the Internet. This may be a router within the home or any router offering a Wi-Fi hot spot in the location of the user. The method can therefore be used not only in domestic environments but when the user is away from home such as visiting relatives, staying in a hotel and so on. Preferably the user-wearable device communicates directly with an Internet-connected router using the Wi-Fi protocol. With such a direct connection then no additional intervening hardware such as a smartphone (which is not acting as a router) or a base station is needed. This simplifies the method, makes it more portable and reduces the risk of failure of the system due to malfunction or uncharged intervening devices which are not dedicated to use with the method. Preferably the connection between the user-wearable device and the remote analysis system is a physically wired system other than the single wireless link to the user-wearable device itself.

As has been discussed the method provides ongoing live monitoring and preferably provides continuous analysis of the sensor data such that the maximum period of user activity, throughout the monitoring period, for which no data is analysed is less than 1 second, more preferably less than 0.1 second.

The time delay between the acquisition of sensor data and the initiation of analysis of the data by the remote analysis system is less than 1 second, preferably no longer than 0.1 seconds.

The method is preferably effected by a cloud computing service model. The analysis is generally performed by the remote analysis system by processing the sensor data with one or more artificial intelligence algorithms, such as machine learning algorithms and/or machine reasoning algorithms.

It may be advantageous to initially analyse some training data to assist with selecting algorithms to use in the method or to provide initial values for the parameters used in the algorithms. The method may therefore comprise, prior to analysing the sensor data, obtaining a training data set comprising training sensor data which is representative of actual or simulated sensor data relating to the physical mobility of one or more users, and the method may further include the use of training event data which includes data indicating the existence of instability events corresponding to the training sensor data. For example the algorithms may be trained using data representing specific types of falls where the data describing the category of fall that occurred is also presented to the algorithms. The method may also comprise storing the sensor data obtained from the user and using the sensor data as a further training data set for the remote analysis system to improve the accuracy of the detection of user instability events.

As has been described in association with the first aspect the method may include communicating an alert message to one or more recipients in response to the alert data being generated. Textual messages may be received from a predefined source and the method may provide converting a textual message into a voice data file at the remote analysis system, transmitting the voice data file to the user-wearable device and causing the user-wearable device to produce an audible spoken output to the user thereby communicating the content of the textual message to the user.

The method may also comprise storing the sensor data representing the mobility activity of the user which has occurred during a trend period at least greater than the monitoring period, and then analysing the stored data with the remote analysis system so as to generate trend data representing trends in the mobility activity of the user over the trend period. The trend period may be at least one month in cumulative duration. Such data may be used to detect a deterioration in the balance of the user. This information may be provided to recipients registered with the system such as carers or medical personnel and thereby enable holistic management of both instability/falls detection and prevention.

The method may also comprise receiving at the remote analysis system a textual message from a predefined source, translating the textual message into a predefined preferred language at the remote analysis system, transmitting the translated textual message to the user-wearable device, and causing the user-wearable device to display the translated textual message to the user.

BRIEF DESCRIPTION OF EMBODIMENTS

Some embodiments of a user mobility monitoring system and method according to the invention are now discussed below with reference to the accompanying figures, in which.

DESCRIPTION OF EMBODIMENTS

We now describe an embodiment of the invention. Firstly we discuss suitable apparatus to implement the embodiment in association with FIG. 1. Secondly we then describe how the apparatus may be used to implement a practical user mobility monitoring system. Some specific use case examples are also provided to demonstrate practical applications.

Figure 1:
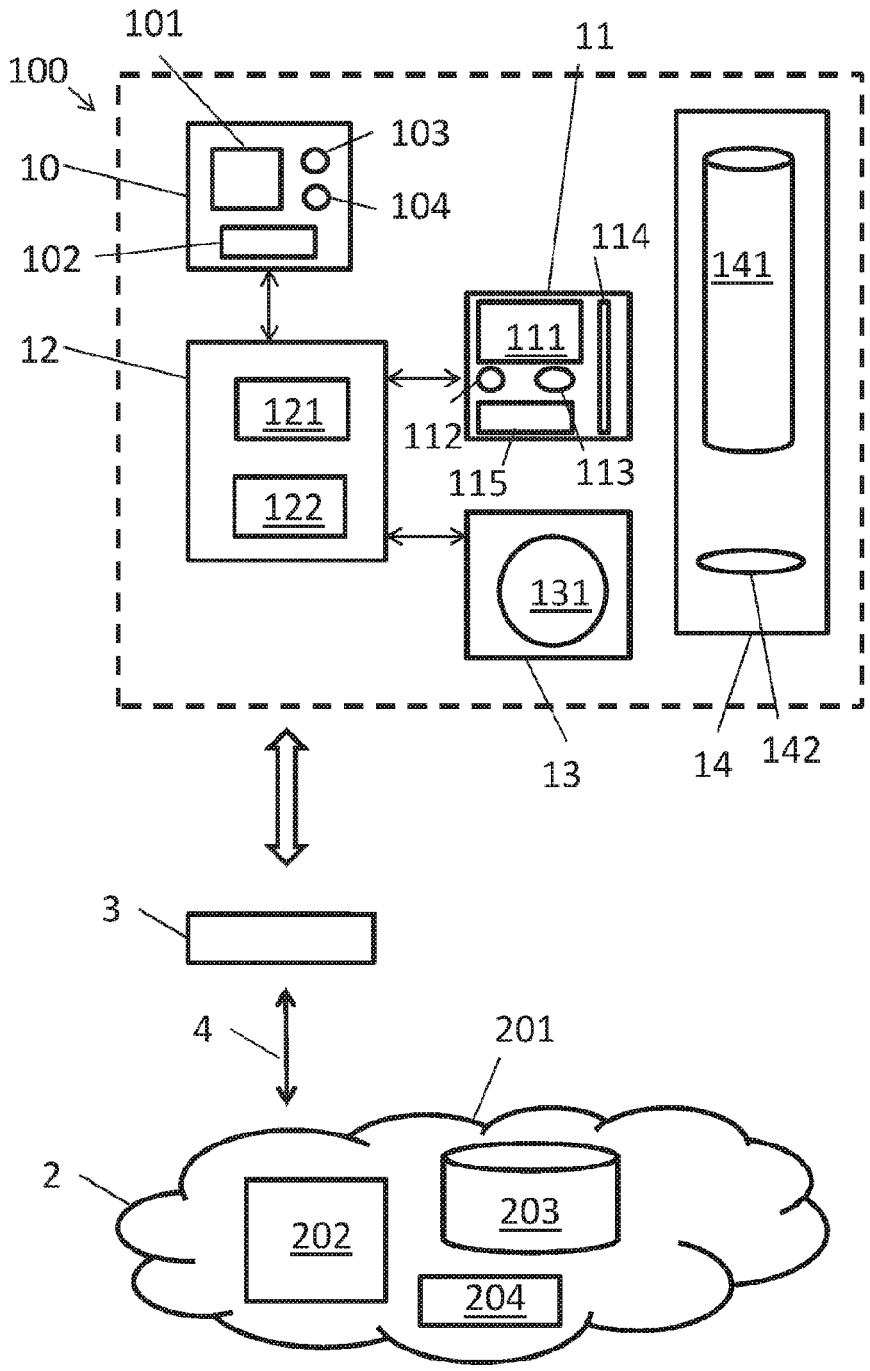
FIG. 1 is a schematic representation of a system according to a first embodiment.

The system now described is denoted the CuraPal™ system. This has two principal parts as shown in FIG. 1: a user-wearable device 1 (CuraPal™ Device) for obtaining data describing the activity of the user, and a remote analysis system 2 (CuraPal™ Cloud) for analysing the monitored data and detecting a user instability event such as a fall by the user. When operational these two principal parts communicate by an intervening network taking the form of an internet connected wireless LAN which is indicated by a router 3 and arrow 4 (denoting the Internet) in FIG. 1.

The two principal parts of the system 100 are now discussed in detail.

User-Wearable Device

In the present embodiment the user-wearable device 1 is a physically compact and slim device, similar to a small smartphone handset and which is designed to be worn by a user at approximately waist height in the region of the hip. A simple clip or other fastener allows attachment to clothing or a belt. The purpose of the user-wearable device is primarily to monitor the movements of the user by whom it is worn and to send data relating to this to the remote analysis system 2. The user-wearable device 1 is also designed to provide information to the user and to receive information from the user in a manner to be described later. The waist/hip mounting of the device is beneficial for this type of monitoring (located on the trunk of the body close to the centre of gravity) although mounting such a device to another area of the body is contemplated.

The user-wearable device 1 comprises a number of subsystems, these being:

1) A sensor subsystem 10;
2) A user interaction subsystem 11;
3) A communication and application subsystem 12;
4) A sound subsystem 13; and,
5) A power subsystem 14.

Sensor Subsystem

The sensor subsystem 10 is a real-time sensor acquisition system. This comprises a collection of motion and environmental sensors. The sensors are provided with a dedicated real-time sensor 32-bit processor 102.

The main sensor set 101 provides ten independent parameters relating to the motion or position of the user-wearable device 1. These sensors include accelerometers for measuring translational movement in three dimensions, gyroscopic sensors of measuring rotational movement on three orthogonal axes, magnetic sensors for providing three-dimensional orientation information and a high resolution barometric sensor for providing altitude information (such a sensor having a comparatively low data rate). The sensor set also contains several internal processors for calibrating and performing sensor fusion on the data from the sensors. In addition a minimum of secondary sensors are provided in the form of temperature 103 and light sensors 104. Multiple temperature and light sensors are provided in different locations on the user-wearable device housing. The temperature sensors can be used to detect hypothermia conditions for example (either in the ambient environment or in measuring the skin temperature of the user). Likewise the light sensors may provide information on ambient lighting conditions and indicate whether the user is lying upon the user-wearable device 1. Wherever possible, on-chip sensors are selected to perform the sensor functions.

The sensor 32-bit processor 102 is connected to these sensors over a private I2C (Inter integrated circuit) and/or SPI (Serial Peripheral Interconnect) bus that can be read continuously at a maximal data rate. Sensor-raised interrupts can also be processed for interesting on-chip motion sensor 'detection events' and these can be also inserted into the sensor data stream. The capabilities of the user-wearable device are enhanced by the use of any and all data available from a particular cohort of sensor chips.

The data from the sensors is provided as a sensor data stream. The sensor data stream is processed in an unusual way in that at any time, the last 10 seconds' of streamed data is stored in a ring buffer in memory and a time-subsampled data set is sent via high speed universal asynchronous receiver/transmitter (UART) continuously to the communication and application subsystem 12 for streaming to the remote analysis system. When a possible user instability event, such as a possible fall by the user, is detected by the remote analysis system 2 then the remote analysis system 2 can request a high time-resolution data dump of the last 10 seconds sensor data be uploaded, again via the communication and application subsystem 12 so as to allow the remote analysis system to analyse in detail the data with the aim of accurately determining whether the user has experienced an instability event which may require the user to be contacted or assisted. The data may be archived or used later in further analysis with the aim of improving the instability event detection.

User Interaction Subsystem

The user interaction subsystem can be thought of as a combination of a display, haptics and user interface systems. This subsystem also consists of a dedicated 32-bit processor. In the present case a display panel 111 (typically LCD or OLED), buzzer 112, haptic transducer 113 and touch controllers 114 are provided. These work together to deliver the device's User Interface (UI). A proximity sensor and gesture controller provide the capability of interactions when the device is not being worn. For example the user-wearable device may wake and/or greet its user each morning when sensing proximity or motion nearby (for example, when placed on a bedside table).

The display 111 is connected via a private SPI bus to the 32-bit processor 115 of the user interaction subsystem. The current 5.6 cm (2.2 inch) display 111 typically has a resolution of 320×240 pixels and can display text messages to the user in a readable typeface. The 32-bit processor 115 stores the typefaces and renders the messages and graphics on the display 111. It is connected to a UART of the communication and application subsystem 12 and receives the text to display over this UART channel.

The buzzer 112 and haptics transducer 113 are also controlled by the 32-bit processor 115 to provide physical feedback when SMS messages or other notifications are delivered to the user-wearable device 1.

The touch controllers 114 (only one shown in FIG. 1) employ two SwipeSwitch™ strip sensors which are waterproof swiping sensor strips that provide simple touch and multi-swipe gesture controls for the device. These interface via I2C to the 32-bit processor 115 and are positioned next to the display. Alternatively a trackpad may be employed or the display may be touch-enabled to respond to similar gestures.

Communication and Application Subsystem

The communication and application subsystem 12 provides central application services and Wi-Fi connectivity to the remote analysis system 2. This is implemented using recently available SOC (System-on-Chip) or a SOM (System-on-Module) technology, each containing a 32-bit application processor core 121 and a complete Wi-Fi hardware implementation including Wi-Fi application processor 122.

The Wi-Fi application processor 122 receives the sensor data stream from the sensor subsystem 10 and streams this to the remote analysis system 2 using an encrypted reliable datagram protocol in real time.

A crypto engine (embodied in hardware, on a chip) is employed to provide and authenticate a unique identity for the user-wearable device 1. This crypto engine also provides keys for hashing, signing and encryption of the data streams and other messages between user-wearable device and the remote analysis system. The remote analysis system 2 can verify the user-wearable device's identity and the validity of messages sent from the device when signed by this crypto engine. In the hardware, the private keys used are kept inside the chip and never leave the chip.

The Wi-Fi application processor 122 is in periodic contact with the remote analysis system 2. It will receive notifications from the remote analysis system regarding user instability event detection, received/sent SMS texts and other events, and then take appropriate actions with the other subsystems:

a) In the case of fall detection processing the remote analysis system 2 may request a high time-resolution data burst of the last 10 seconds from the sensor subsystem's 10 processor and this data is uploaded to the remote analysis system 2 for more detailed analysis as mentioned above.

b) Text message replies from carers which are received from the remote analysis system 2 are sent to the user interaction subsystem for display 111.

c) Received text messages from the remote analysis system 2 are also converted to high quality audio speech by text to speech (TTS) software in the remote analysis system 2. Speech audio files are downloaded by the Wi-Fi application processor 122 and then passed on to be played by the audio subsystem 13 (discussed below). In lower internet bandwidth situations the TTS conversion could be performed on-device but with fewer languages and/or less fidelity available.

d) System logging and health, battery and power subsystem 14 (see below) status data are also periodically sent to the remote analysis system 2 so actions may be inferred and taken. For example if the device battery is low then a message can be displayed to charge the device 1 and carers notified. As a further example, if the device is not being worn at the usual times then this can be detected and carers alerted if this behaviour by the user is not corrected after attempting to inform the user with messages.

Sound Subsystem

The sound subsystem 13 includes a piezoelectric speaker 131 that is very thin and has been selected to be free of electromagnetic emissions that would disturb the sensors. This is driven by an output from the audio circuitry connected to the communication and application subsystem 12.

Power Subsystem

The power subsystem 14 provides stabilised voltage and current from a Lithium Polymer (LiPo), (or alternatively Lithium Iron Phosphate, LiFePO) battery 141 to the various other subsystems. It also charges the LiPo battery 141 in a safe manner using protections against overcharging and other behaviour likely to reduce battery performance or cause malfunction. There are two power rails in the user-wearable device, delivering 3.3V and 5V respectively. The power subsystem can boost the LiPo voltage to 5V and also buck/boosts the battery 141 to 3.3V as it discharges from being above to below 3.3V. In an alternative embodiment it is possible to use only one 3.3V (or less) rail which lowers power consumption even further and simplifies the power subsystem. Further battery performance improvements can be achieved by tuning of the power management on the various subsystems to further optimize the power consumption.

Battery charging is achieved via a flat Qi coil 142 (providing inductive charging) that is placed directly inside the housing at the bottom of the user-wearable device. This Qi coil 142 will provide 5V at up to 500 mA of current when placed on a Qi charger pad (as in the case of charging mobile phones). This is connected directly to the power subsystem charging circuitry which is advanced, acting like a UPS to share intelligently the charging power between the device operation and the battery charging function. This keeps the user-wearable device active during charging in a "ready to go" state and also able to perform housekeeping functions whilst at rest.

An inductive charging method is particularly beneficial for users with reduced coordination (such as the elderly) since many such users find it difficult to work with the small micro USB plugs and sockets used by chargers. Placing the user-wearable device on a Qi charging pad is a much simpler operation for the user, even if they have some challenges such as arthritis.

Remote Analysis System

The remote analysis system 2 comprises software systems developed by the present inventors which are executed in either public or private cloud computing environments, denoted 201 in FIG. 1. In the present embodiment the software is run in several data centres 202 worldwide to provide low-latency, reliable services to a local region and comply with data protection and location laws. The software is designed using virtualisation and scaling techniques to ensure that the remote analysis system services can scale massively over time.

The Remote analysis system provides several key functions:

1) Data stream ingress and processing subsystems that receives real-time data streams from numerous uniquely identified user-wearable devices 1.
2) Processing of the data streams using Artificial Intelligence (AI)/Machine Reasoning algorithms that use the data received to recognize and detect user instability events such as falls.
3) A communications controller 203 that handles the procedure when a fall has been determined. Such a procedure includes the sending of SMS/messaging notifications and receiving SMS/messaging data and routing them to the correct user-wearable device. The communications controller also manages all other periodic and housekeeping functions regarding the user-wearable devices.
4) Learning algorithms which learn day-to-day patterns of movement and use this data to improve fall detection for users on a personalized basis over time.

5) Long term Data storage 204 and retrieval of streamed data for analysis over shorter and longer timeframes. For example, in the case of longer timeframe processing, six months or more of data is retained so as to enable AI processing to detect deterioration of the user during that period for warning and prevention.

Other Hardware

The additional hardware needed to connect the user-wearable device to the remote analysis system is widespread in the form of a Wi-Fi router 3 connected to the Internet 4 using an Internet Service Provider or example. Implementation of the embodiment using Wi-Fi communication provides a number of advantages over prior art systems, despite its greater electric power requirements. Currently in 2016 Wi-Fi is readily available in domestic and public environments with the data rate, range, reliability and ease of use that provides many practical advantages. Wireless coverage in the home or garden is of course extremely important and can be completed where necessary using boosters (available since the last decade) or recent (2015) technologies such as Wi-Fi routers that focus on devices as they move around the home. The user-wearable devices can employ smart setup for the Wi-Fi in the home and can be setup for other locations, switching automatically between them in the same way that a smartphone does.

Wearers can also employ a Mi-Fi 4G hotspot to provide a battery operated, small Wi-Fi access point that can accompany them outside, kept in a pocket or handbag/male purse so taking their internet connectivity and all the functionality and protection with them.

We turn now to an explanation of how the apparatus as described above may be used.

Initial Machine Learning

When the system is initially used for a particular user, such as an elderly person living in their own home, the system 100 is unaware of the usual activity habits of the user. However it is desired to provide immediate protection for the user in question and so the processing algorithms in the remote analysis system are provided with initial parameters based upon previously obtained data from a number of test subjects.

The AI/machine reasoning employed also applies heuristics i.e. rule-based reasoning to work together with machine learning algorithms to provide the most accurate decision making. This is important in the early stages of running the system, as training data is beginning to be acquired from the user in question.

More specifically, the machine learning algorithms are initially trained on training data sets derived from the sensor data of a user-wearable device 1. These training data sets are processed to 'clean' them and extract a set of position and movement vectors.

In order to provide the training data sets a number of fit personnel are trained to move, walk and fall like older people (and other types of vulnerable users) whilst wearing the user-wearable device 1. This in particular provides the initial 'falling' data in the training data sets which is representative of user instability events.

Secondly, wearers of the device 1 both from a target group (such as a group of elderly people) and a control group of healthy people wear the device during an extended Beta test and their data is collected.

These several data sets aid in such tasks as calibration of the devices and most importantly the initial machine learning (ML) training which is performed with data derived/processed from these various sets of raw data.

Figure 2:
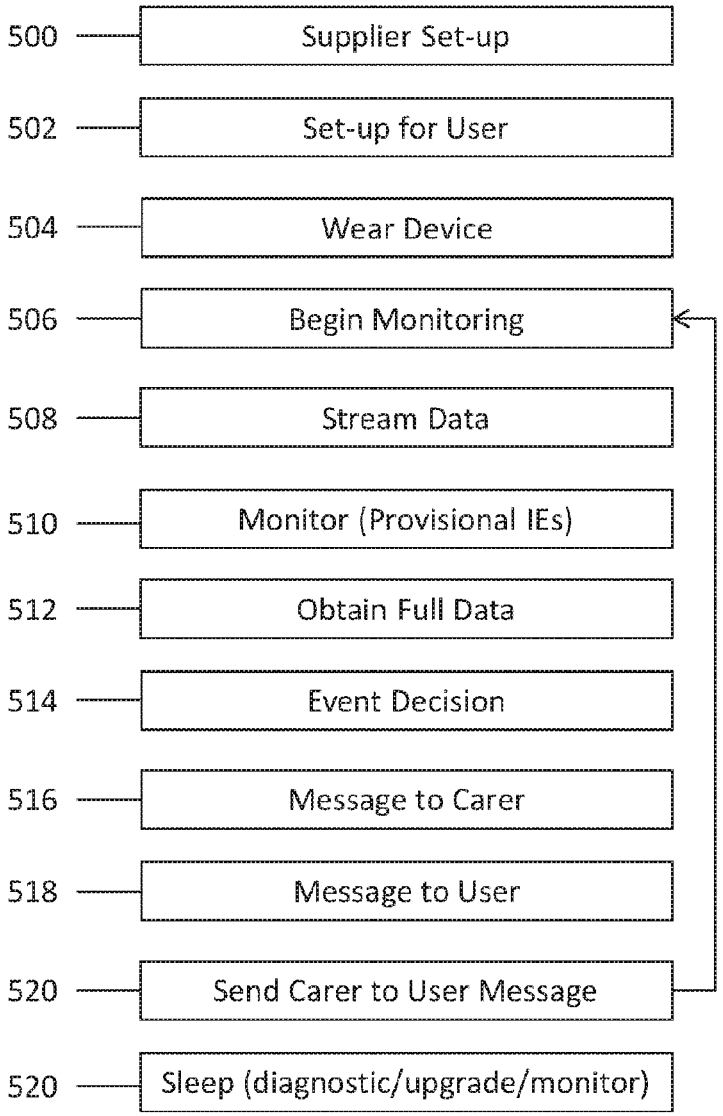
FIG. 2 is a flow diagram of a method according to the first embodiment.
Figure 3:
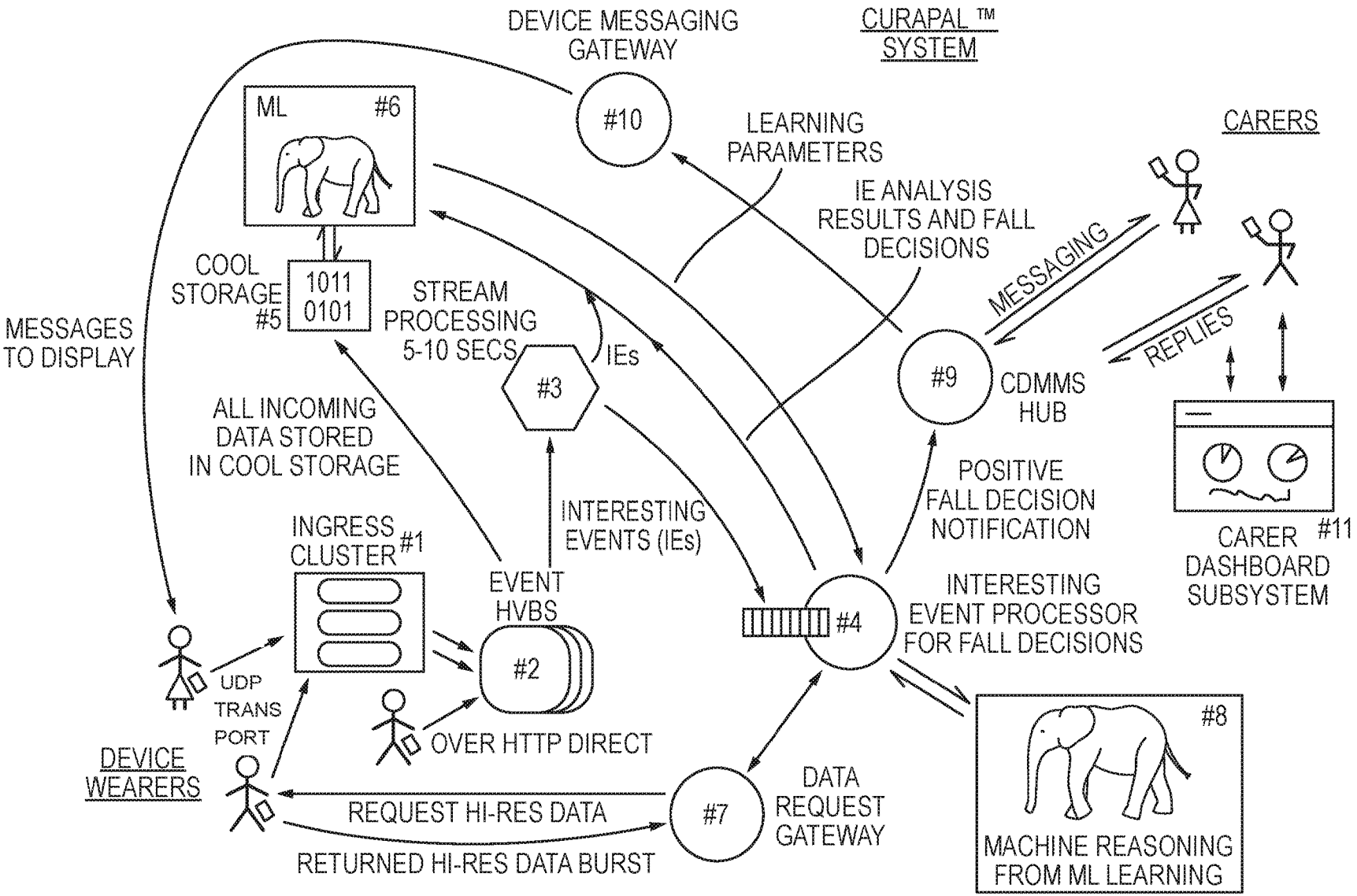
FIG. 3 is a schematic process diagram according to the first embodiment.

We now describe the use of the system 100 in association with the flow diagram of FIG. 2 and the accompanying schematic diagram of FIG. 3.

At step 500 in FIG. 2 the system is set-up at the supplier side. In practice this means that the user-wearable device 1 is provisioned according to the target user, including registering the unique identity of the user-wearable device 1 with the remote analysis system 2. A suitable set of analysis algorithms and associated configuration parameters are chosen based upon the known mobility and medical conditions of the target user by using the techniques described above.

At step 502 the target user is supplied with the user-wearable device 1. This is then set up, typically by a carer or representative of the system supplier, for example by registering the device with their wireless router 3 and installing a Qi coil charger in a convenient location, such as at the bedside of the user. The user is also given instruction on how to use the device, although in practice for the most vulnerable users, little or no understanding of how the system functions is needed. The set-up at the user's location is completed by the user-wearable device 1 being placed upon the charging surface of the Qi coil charger.

At step 504 in FIG. 2, for example in the morning when the user rises from their bed and gets dressed, the user lifts the user-wearable device 1 from the Qi charger surface at attach it to their belt or trousers. The user's waking may have been detected by the sensor subsystem 10 or a waking alarm function may have been set for example. The loss of charging power is sensed by the communication and application subsystem 12 of the user-wearable device 1 and the software causes the user-wearable device 1 to "wake" and enter a fully active mode in which a streamed data connection is established between the user-wearable device 1 and the remote analysis system 2. However, even when in a "sleep" mode during charging the user-wearable device 1 remains in Wi-Fi contact with the remote analysis system 2 so as to perform any housekeeping or update activities.

At step 506 the user begins their daily routine such as washing and making breakfast. The user-wearable device 1 is intended to remain attached to the user during most activities, although in the case of bathing or showering it may be removed and placed in a waterproof pouch of the kind available for smartphones. These are designed to be worn on the body, for example on the upper arm or less preferably, around the neck. The user-wearable 1 device would be removed from its hip mount and set to 'bathing mode' so it would know of its changed position on the user's body and be aware of the 'wet area' situation.

The monitoring of the movement, position and environment of the user begins and proceeds continuously by the generation of data from the sensor subsystem 10.

At step 508 the data from the sensors begins transmission via the communication and application subsystem 12 over the Wi-Fi link to router 3 and then via the Internet 4 to remote access system 2.

Depending upon the sensor types used in the sensor subsystem 10, some of the sensors may generate data at a rate of about 400 Hz. In some cases, even at 1000 Hz. The present inventors have realised that such high data rates may require significant processing and bandwidth resources and that, by sub-sampling the data at a lower rate, reduced processing power is needed whilst the data can be provided at a sufficient rate to enable anomalous activity in the user to be provisionally detected.

The user-wearable device 1 preferably is configured to use a UDP connection so as to send a small number of measurements at a time over a "reliable UDP" connection to a UDP data ingress cluster operating within the cloud implementation of the remote analysis system 2. This is illustrated at #1 in FIG. 3. This utilizes a connection combining fast, lightweight UDP transport networking with techniques that acknowledge and resend dropped packets to make the transport sufficiently reliable.

The cluster servers send the real-time data from each user-wearable device 1 to one or more event hubs shown at #2. The cluster servers do not keep the data once it's been transferred to the event hub; it is simply passed through.

A second option, either additionally or alternatively, which may be used for less reliable or for TCP/IP optimized (or exclusive) networks, is for the data to be directly uploaded to the event hub. The transport approach then employs regular TCP/IP and web service calls. The TCP/IP protocol takes care of error correction, partial or dropped packets and so on.

In either case the event hub #2 stores up to a day's worth of data. API Clients can replay the sensor data stream to other subsystems connecting as clients, as well as supply it directly as it streams in.

From the event hub all data is stored into what is best described as 'Cool' storage (shown at #5). This is cloud based storage that is very large capacity, yet also fairly quickly accessible. By comparison, 'glacial' storage, usually used for compliance or similar requirements, is storage that has great capacity and is very long term, but is also very slow to access (retrieval time can be hours). In the present case the cool storage system is configured to store the data for a lifetime of six months. After that period the data will be deleted and the storage space reclaimed. This cool storage can be accessed in appropriate timeframes for use by other subsystems for further processing (see later).

The cold storage system is linked to a machine learning (ML) subsystem (#6) in the cloud environment of the remote analysis system 2. The ML subsystem runs algorithms on the (up to six months) historical data, learning from day-to-day patterns of movement and actual falls (and other events) recorded. Data identifying that the user did suffer a fall can be provided by carers. This might be achieved by the system messaging carers after such an event and recording their responses or by automatically analysing messages between the user and carers. Personalisation of the instability detection is an ongoing task and is implemented by learning day-to-day patterns of movement for each user. The remote analysis system then uses these learned parameters to improve fall detection for each user on a personal basis, improving accuracy over time. Machine learning is run every few days to a week on each user's recent data to update the learning parameters and continually improve the personalization of the system.

At step 510, having received the data from the sensors at the event hub, the data is passed into a stream processing subsystem (#3). This subsystem lies at the heart of the system 1 as a whole and continuously analyses the last few seconds (typically 5 to 10 seconds) of motion and environmental data from each user-wearable device 1. The use of cloud computing is advantageous here since the inbound data stream from each device is provided continuously which means that real time processing is needed. Cloud computing allows the processing power needs of the system to be scaled to match the processing requirements and in particular the number of user-wearable devices that are processed at the same time.

The stream processing subsystem applies the applicant's software to detect 'interesting events', referred to as a 'IEs' that are candidates for a fall-like event. These are therefore provisional user instability events. The software employs heuristics and ML parameters to achieve this, for which see later. It will be recalled that, through sub-sampling at a lower data rate, not all of the sensor data is provided within the continuous data stream between the user-wearable device 1 and the remote analysis system 2.

Returning to the activity of the user in their home, the data from the sensors may have been streamed continuously for, say, 2 to 3 hours in the present example without any unusual activity being detected. Then, for example mid-morning, when walking across their living room the user may experience a trip causing them to stumble and then impact against a piece of furniture such as their dining table. Whilst the user does not fall to the floor in this instance the angle of their body changes during the event. The rhythm of their walking is disrupted and the shock of them impacting against the table, for example using their arms to prevent them falling, are all detectable by the data from the compass sensors and accelerometers for example. The analysis of the data results in an "interesting event" being detected as a provisional user instability event.

Since for each provisionally detected IE additional "full" sensor data is held on the user-wearable device temporarily, it follows that this higher time resolution data will be of assistance in any further analysis and processing.

At step 512 the data relating to the IE is placed on a queue with an associated IE processor (see #4) in the cloud-implemented remote analysis system 2. When the IE is removed from the queue by the IE Processor, it makes a request for higher time resolution data around the IE through a request gateway (#7) service. The request gateway contacts the user-wearable device 1 via the Internet and router 3 over Wi-Fi and requests an upload of a data burst from the device containing the full time resolution data for the last 10 seconds. When this has been uploaded, the request gateway passes the data burst back to the interesting event processor #4.

The IE processor #4 then uses this high resolution data, working together with a machine reasoning subsystem (#8) to make a decision on whether the user has suffered a significant instability event such as a fall. In the case of a fall for example, the decision includes the type of fall. The system 100 is able to identify six different types of fall.

As mentioned earlier, the machine learning subsystem (#6) performs a regular analysis on the last 6 months of data, including events which were positively identified as falls or other instability events. This data is particularly important since it is specific to the user in question and therefore provides information upon their daily activities and, where an instability did occur, how that manifested itself in the sensor data. The machine reasoning subsystem has access to the learning parameters extracted by the machine learning subsystem (#6). In addition the machine reasoning subsystem has direct access to all of the user data in the cold storage (#5), together with the live feed from the event hub. It can use these to make the fall analysis and determination from the uploaded data in the high resolution data burst. The live information immediately following the data burst is important since this indicates the immediate status of the user such as whether they are lying still or whether they are getting to their feet.

At step 516 if a fall is detected, then a notification is sent to the communications hub #9 of the remote analysis system 2. The communications hub #9 sends a "Fall Notification" message to a list of carers assigned to the user using the chosen messaging service of the carer (SMS Text, iMessage, WhatsApp, etc.) The detection of the instability event and the categorisation of the type of event that has occurred can be used to select the type of message to send to the carers or indeed to select a subset of carers. For example where, in the present case, the user has stumbled and an impact (against the dining table) has been detected, but the most recent data indicates that the user has remained upright and mobile, then the message to a carer may be more of an advisory rather than an urgent nature. This categorisation is of great practical importance to enable an appropriate level of intervention and care to be provided without the user feeling that they are causing the carers disruption or difficulties.

At step 518 the communications hub also sends a message through a device message gateway (#10) to the user-wearable device where the message will be displayed on the display 111. For predefined "standard" messages associated with different event types an appropriate sound file verbalising the message is sent via the Internet link and Wi-Fi to the user-wearable device and the message is played audibly via the speaker 131 of the sound subsystem 13. In the case of a fall event the message will be to inform the user that carers have been notified of their fall and help is on the way. The system may also ask for a response from the user which, if it is not received, may cause the system to call the emergency services. In the case of a stumble as experienced by the present user, then the user may be asked to swipe one of the touch controllers 114 to indicate that they don't need immediate medical assistance.

At step 520 when carers reply to the notification message their replies are routed back to the communications hub. This will then route them through the device message gateway (#10) onto the user-wearable device to be displayed and read out. In the case of the verbal audible message the communications hub will apply text to speech processing to generate an audio file for transmission to the user-related device 1.

As will be appreciated there are numerous ways in which messages between carers, users and the system 1 may be handled, prioritised and presented. These may be configured particular to each user and the group of carers concerned depending upon the medical needs of the user and the proximity and availability of the carers.

At step 520 when the remote analysis subsystem has ensured all messages have been relayed between the users and the carers the system returns to its normal ongoing function at step 508.

At step 522, when the user retires to bed, for example after 16 hours awake, they remove the user-wearable device and return it to the Qi charging pad. The charging via the Qi coil is detected and the application processor 121 then sends an end-of-monitoring notification to the remote analysis system 2 indicating that no further sensor data may be expected. The user-wearable device then enters a sleep mode in which various data may be exchanged with the remote analysis system 2 whilst the user sleeps. Such data may include diagnostic data relating to the performance of the user-wearable device, including its battery performance status. Any firmware upgrades can also be implemented. Although the movement of the user cannot be monitored whilst the user-wearable device 1 is charging, the device may continue to monitor periodically for environmental problems such as the temperature falling too low. If an environmental problem is detected then the user-wearable device can communicate to the user and the remote analysis system 2 to advise carers of the potential problem.

As an additional benefit, carers are also provided with access to up to date information regarding the user through a carer dashboard subsystem (#11). This gathers data from the various subsystems and provides a web or app-based dashboard for carers. Carers can log in to the customer-facing side of this subsystem and view their dashboard on their smartphone or tablet. Typical information that might be displayed via the dashboard includes a summary of recent monitored activity, messages passed between carers and the user, the temperature at the user's location and longer term trend data relating to the user.

In the event of an instability having occurred then a few hours later the remote analysis system 2 may be configured to send a query message to the carers enquiring as to the nature of the incident that was detected. They may be asked to categorise the incident in terms of its type and its seriousness and this data may then be communicated to the cool storage #5 and taken into account by the machine learning subsystem. Such positive confirmation of events is particularly useful in supervising the ongoing training of certain types of AI algorithms.

Longer term Data storage and retrieval of streamed data is also implemented in the system of the present embodiment. For example, the last six months of data is retained so as to enable machine reasoning processing to analyse and detect deterioration of the user over that period. For example, the system looks for instances of off-balance or other loss of control including shaking, unsteadiness and other indicators, and analyses if these are increasing over the time period. The system can then take proactive steps, by warning carers to take preventative actions such as installing handles and/or other assistive aids around the home. As a result, this data analysis has a positive outcome in reducing the injuries and distress caused by falls to the user, together with benefits to wider society such as reducing hospital admissions.

Alternative Implementations

In addition to the system fully discussed above, a number of alternative ways of implementing the system are now briefly mentioned:

1. An alternative implementation uses a Linux-based SOM (System-on-Module) together with a microcontroller to manage the real-time sensor capture. Linux cannot provide real-time capture so the microcontroller unit (MCU) is used as the sensor processor to perform this.

2. An alternative implementation uses a modifiable smartphone platform, such as the Moto Z range of phones from Motorola. Worldwide there are currently three phones in this range. Moto Z's are designed to be enhanced using 'Mods' that are modules that can contain custom electronics that add features to the phone. The Mods snap onto the back of the Moto Z, secured by magnets and connected by water-repelling contacts. When a Mod is mounted, the phone senses this and downloads the appropriate software (including Mod firmware and an app) from Google Play and installs this. Whilst the use of Android phones causes performance problems due to latency in their operating systems (effectively preventing the reading of sensors predictably in real-time), this is solved on the Moto Z platform by making a system specific Mod that contains all the sensors together with the sensor processor (the sensor subsystem 10). The Mod communicates the sensor readings to the smartphone via a bridge to the Moto Z that is part of the platform. Unencumbered by an operating system, the sensor processor operates in real-time and also predictably, just as it does on the user-wearable device 1 described above. A corresponding app provides a user interface, displaying and reading onscreen messages. It can be locked as the active application. Appropriate Android services take care of communicating with the remote analysis system 2.

Other Example Use Scenarios

We describe below two further example scenarios of how the system may be used to monitor the activity of users.

Scenario 1—User: "Alice"

1. Alice is 75 years old and lives at home. Alice wakes up in the morning. She takes her user-wearable device from the bedside table after it detects her movement during her waking (and her proximity) and signals to her with a positive audible greeting. She hooks the device onto her dressing gown.

2. Alice makes her way to the kitchen to prepare a cup of tea. Although the lighting level in the room is low, Alice is able to walk around the home without an aid.

3. When in the kitchen Alice trips over her pet cat and falls forwards, knocking her head on the corner of the kitchen table and falling unconscious to the floor.

4. The user-wearable device 1 has been streaming Alice's motion and environmental data to the remote analysis system since she removed it from its charger and the software is continuously analysing a time window of the last 10 seconds.

5. The fall is detected by the remote analysis system 2 using heuristics that recognize abnormal data outside of Alice's usual personalized range as discussed in more detail above.

6. The software running in the cloud 201 then requests from the user-wearable device 1 a fast data burst of high time-resolution data of the last 10 second time window.

7. This event data is then processed by the artificial intelligence and machine reasoning algorithms to determine in a personalized way if one of several types of falls has occurred.

8. The remote analysis system 2 decides a fall has occurred and so instigates a communication protocol back to the user-wearable device asking Alice if she is okay as follows:

9. This communication triggers in the user-wearable device:

a. A haptic vibration of the device; and b. A flashing screen light notification with a message and/or speaking.

10. When Alice does not confirm she is okay by making a swiping gesture on the touch controllers 114 on the user-wearable device 1, the device communicates the lack of response back to the remote analysis system 2.

11. The software running in the cloud retrieves the list of carers or appointed contacts and immediately sends a message informing all of them Alice has had a fall and did not respond to the fall query check in. If any message prioritisation or carer prioritisation functionality is enabled then this is treated as a high priority and the message sent to carers communicates the potentially serious nature of the fall and the urgency required in responding. The emergency services may be called in the event that no carers respond within a short timeframe or if the system is set up to directly request attendance of the emergency services in the event of a persistent null response following a serious fall.

12. The carers receive this message via SMS text or other messaging services. The remote analysis system 2 interfaces to these messaging services through known APIs.

13. The carers simply "Reply-to" the message received (depending upon the manner in which it was communicated) and their reply will be routed via the remote analysis system 2 directly to the user-wearable device Alice is wearing.

14. The carer's message will be displayed on the display 111 and/or read aloud to Alice (via speaker 131) who may have recovered consciousness but is unable to get up from the floor.

15. Alice can hear the incoming message sound and/or can read the message on the display and is therefore reassured that help is on the way.

16. Other Carers also respond sending messages of reassurance and the actions they are taking to help Alice.

17. The favourable outcome for Alice is that within a very short time her fall has been accurately detected, carers are notified and she is not lying on the kitchen floor undetected for hours, instead she is reassured and has less mental suffering and likelihood of physical complications.

Scenario 2—User: Eddie

1. Eddie is 80 years old. He lives alone and insists to his adult children on leading an independent life in his own home.

2. Eddie's children agreed with Eddie that he will wear the user-wearable device 1 on his belt.

3. Eddie has been prescribed blood pressure medication that can cause a fast drop in his blood pressure soon after he's taken it. Eddie is used to this and can compensate for it.

4. However, Eddie's medication is changed by his new physician.

5. Over the next few weeks Eddie becomes unsteady on his feet for an hour or so after taking the medications.

6. Eddie wears his user-wearable device 1 each day as he promised his daughter he would.

7. The user-wearable device 1 streams Eddie's complex motion data from its multiple sensors to the remote analysis system 2 software in the cloud 201 daily, second by second.

8. On a longer time scale of days this data is used to implement personalization of care in addition to providing automatic fall detection (as shown in Scenario 1 above).

9. To aid in personalized fall prevention, the machine learning software (#6) analyses up to 6 months of Eddie's data and analyses changes in Eddie's movements such as swaying, gait changes, instances of off-balance etc. In this case it detects the deterioration in Eddie's movements due to the medication change.

10. If the remote analysis system 2 sees a worsening trend in any of these elements it will notify the carers by messaging and via the carer dashboard to inform them of this so they can consider taking remedial action to prevent a possible future fall.

11. In this example of Eddie the deterioration and increased risk of falling is due to the change in medications. It could also be simply age related deterioration or onset of one or more various medical conditions.

12. The system 100 can give an early warning of changes that would otherwise go unnoticed, leading to actions taken for fall prevention.

13. The data, gathered by remote analysis system 2 on a week-by-week basis, can also be summarized and displayed on the carer dashboards. The data can also be entered in a patient medical history record by interfacing with health care systems' electronic patient record APIs to give physicians a history of the patient to enable them to better assess, diagnose and treat the patient.

Outboard Mini-Wearable and Charging Scenario

Figure 4:
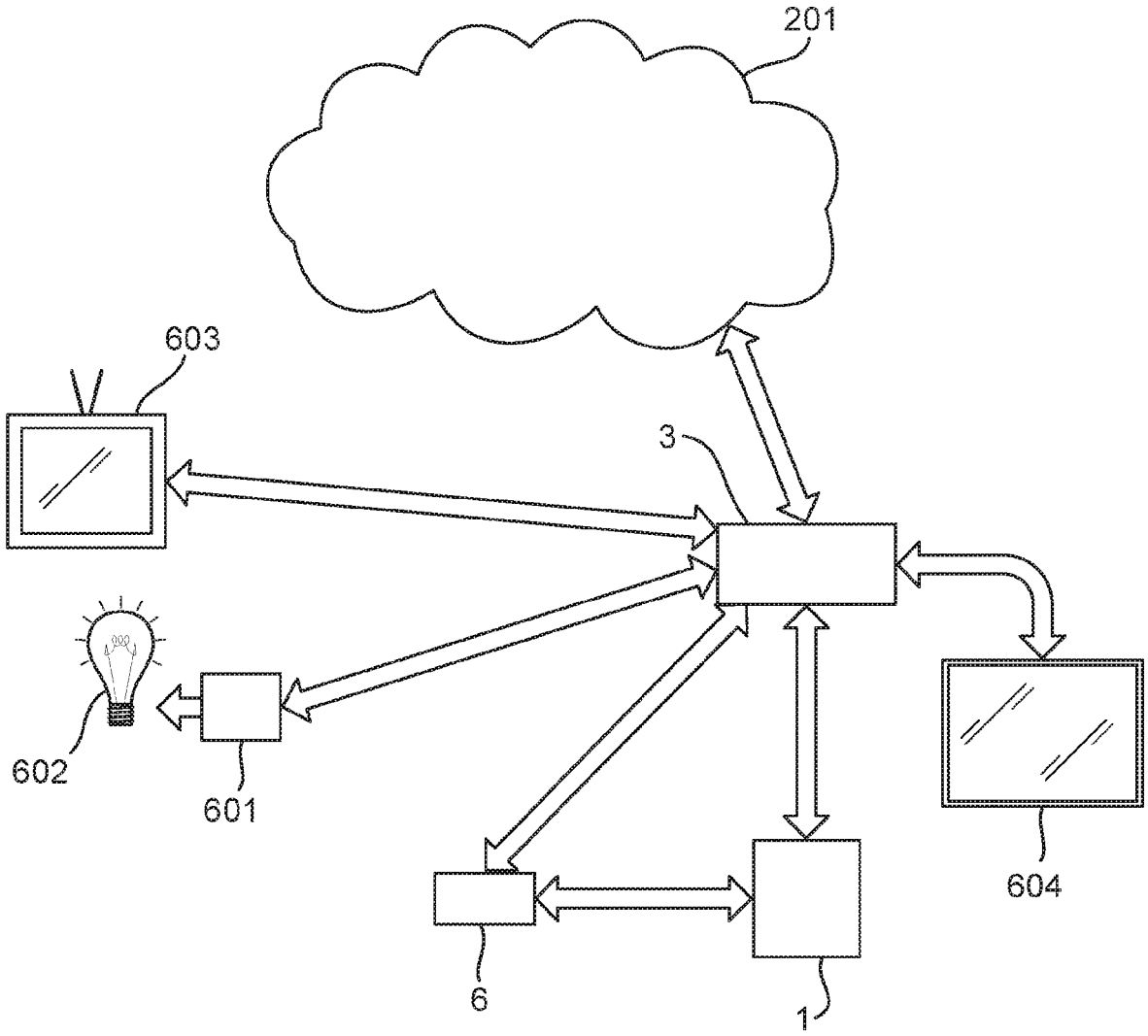
FIG. 4 is a schematic representation of a system according to a second embodiment.

In a further embodiment illustrated with reference to FIG. 4, one or more secondary user-wearable devices 6 are provided in addition to the user wearable device 1 (hereafter referred to as the primary user-wearable device 1 when described with reference to the secondary user-wearable device 6) described with reference to FIGS. 1-3.

The secondary user-wearable device 6 is a brooch-sized mini wearable that can be worn to provide Fall Protection at night time, or any other time, while the primary user-wearable device 1 is charging its battery. The secondary user-wearable device 6 can be envisioned as an 'outboard' version of the primary user-wearable device 1.

The secondary user-wearable device 6 is attachable to a user's clothing or body in various ways to suit both male and female anatomy. In some examples, the secondary user-wearable device 6 may comprise a clip for attachment to a user's clothing or body. In other examples, the secondary user-wearable device 6 may be attached permanently to the outside of an item of clothing, or may be disposed in a pocket, an adhesive sac or sewn into an item of clothing. In one example particularly suited to hospital usage, the secondary user-wearable device 6 is attached directly to skin in a waterproof non-allergenic gel container.

The secondary user-wearable device 6 may have a high level of water- and dust-proofing, e.g. IP67 together with high-temperature range electronic components, so that it will stay operational under harsh conditions.

For showering it may be placed in a small plastic sac that can be attached to an armband or other body attachment.

As described in detail below, the secondary user-wearable device 6 may be used to provide sensor data to the remote analysis system 2 when the primary user-wearable device 1 is not being worn by the user, such as when the primary user-wearable device 1 is being charged. As described in detail below, the remote analysis system 2 may determine which of the primary user-wearable device 1 and secondary user-wearable device(s) 6 is currently suitable for detecting the user's motion. The remote analysis system 2 may control the primary and secondary user-wearable devices such that motion data is transferred from one of the devices to the remote analysis system 2 for analysis. For example, a user may remove a primary user-wearable device 1 that the user is wearing and place it on a Qi charging pad for charging. The remote analysis system 2 can detect that the primary user-wearable device 1 is being charged based on telemetry received as part of the data stream received at the remote analyis. This can include NFC data from the Qi pad and/or voltage/current sensing. The remote analysis system 2 may command the primary user-wearable device 1 to enter a charging mode. While the primary user-wearable device 1 is in the charging mode, the remote analysis system 2 may connect to a local, active secondary user-wearable device 6 that is worn by the user.

Communication between the remote analysis system 2 and the secondary user-wearable device 6 may or may not use the primary user-wearable device 6 as an intermediary, as described in detail below.

The secondary user-wearable device 6 comprises the same sensors as primary user-wearable device 1 (and described in relation to FIG. 1), employing low-power processing hardware such as MCU(s), FPGAs or other suitable processing hardware to read and prepare the sensor data for sending to the primary user-wearable device 1. These processing resources can also be employed for user interaction such as gesture recognition.

For user audio and visual interaction, the secondary user-wearable device 6 will comprises a haptic vibrator, microphone and speaker transducer. For visual interaction RGB LED(s) with different colors or a small display such an OLED, AMOLED or SuperAMOLED can be used to display icons rather than text, as these are more legible by visually impaired users.

The secondary user-wearable device communicates with the primary user-wearable device 1 using low-powered Wi-Fi, cellular, 5G or possibly other suitable radio tech, such as long-range Bluetooth 5+. In further examples, alternative versions of the wearable may combine these transport technologies. Communications between primary and secondary user-wearable devices are encrypted apart from, and in addition to, that of standards such as Wi-Fi.

The secondary user-wearable device 6 may be implemented using printable sensor/electronics tattoo technology.

Operation of Secondary User-Wearable Device

The secondary user-wearable device 6 can employ two methods of operation, depending on their networking capabilities and the local environment:

i) When a direct connection to the local network and the internet is available via a transport (e.g. low-power advanced wi-fi (preferred) or cellular connection), the secondary user-wearable devices 6 that are so equipped will employ two way communication with the remote analysis system 2, streaming a sensor data uplink in real-time to the remote analysis system 2. This communication is two-way so the remote analysis system 2 can send commands to both the primary user-wearable device 1 and the secondary user-wearable device 6.

b) When only a device-to-device connection is available, (e.g a Bluetooth5+ connection), the secondary user-wearable device 6 will employ two way communication with the charging primary user-wearable device 1. The secondary user-wearable device 6 streams sensor data in real-time to the primary user-wearable device 1, which in turn sends the received sensor data in real-time to the remote analysis system 2 using its Internet connection. The remote analysis system 2 communications are two-way so the remote analysis system 2 can send commands to both the primary user-wearable device 1 and the secondary user-wearable device 6 to provide command/control of the primary and secondary user-wearable devices while receiving data identifying user interactions.

Devices Assignment and Interaction

The secondary user-wearable device 6 is assigned to a single primary user-wearable device 1 device.

As described above, the primary user-wearable device 1 incorporates a crypto engine (embodied in hardware, for example, on a chip) that is employed to provide and authenticate a unique identity for the user-wearable device. This chip also holds other keys and can perform in hardware data signing and hashing functions based on these keys. After initial factory programming these keys never leave the primary user-wearable device 1 device.

The secondary user-wearable device 6 comprises a crypto engine that may be of the same type as provided on the primary user-wearable device. The secondary user-wearable device 6 can be prepared for use with a single primary user-wearable device 1 by installing a matching key(s) into its own internal crypto engine. The communications and identities may then be confirmed between the secondary user-wearable device 6 and the primary user-wearable device 1 by exchanging of hashed/signed messages without the keys ever leaving either device.

An advantage of this system is that 'pairing' in the regular mobile device sense between the secondary user-wearable device 6 and primary user-wearable device 1 is not necessary, unlike common Wi-Fi and Bluetooth mobile devices.

Multiple secondary user-wearable devices 6 may be supplied to a user and assigned to work with a single primary user-wearable device 1. The remote analysis system usually commands one (primary or secondary) user-wearable device 6 to be active and streaming data at any one time. Multiple secondary user-wearable devices 6 may be attached, as described above, to different items of clothing, for example dressing gown, nightwear, etc. so that the motion of a user may be detected whenever the user wears any of the items of clothing to which a secondary user-wearable device 6 is attached. Each of the secondary user-wearable devices 6 may be provided with unique IDs so that they may be identified as distinct by the primary user-wearable device 1 and the remote analysis system 2.

Sleeping

Secondary user-wearable device 6*s* will sleep to conserve battery power. They wake when necessary on motion or other environmental triggers. For example, when the user changes clothes (possibly activating a different Secondary user-wearable device 6 attached to that clothing) or when user wakes from sleeping and when user begins to rise and get out of bed and move around their living space.

Charging the Primary User-Wearable Device and Change-over to a Secondary User-Wearable Device Charging of the primary user-wearable device 1 is initiated by the user placing the primary user-wearable device 1 onto a Qi charging pad. The primary user-wearable device 1 may prompt the user to initiate charging at a suitable time. The prompt that is sent to the user may be initiated by the remote analysis system 2. For example, the remote analysis system 2 may determine, based on telemetry, that the battery of the primary user-wearable device 1 is below a critical threshold (for example, at 30% capacity).

When the primary user-wearable device 1 is placed on the Qi charger, the primary user-wearable device 1 is not coupled to the user and does not, therefore, obtain motion data corresponding to the user's movements.

The remote analysis system 2 can detect, based on received telemetry, that the user has removed the primary user-wearable device 1 and placed it on the Qi charging pad. Upon detecting that the primary user-wearable device 1 has been removed from the user, the remote analysis system 2 commands the primary user-wearable device 1 to enter into a charging mode. In the charging mode, the primary user-wearable device 1 can connect to a local, active secondary user-wearable device 6 that remains worn by the user and begin processing two-way data streams with both the secondary user-wearable device 6 and the remote analysis system 2.

In order to regain a stream of motion data relating to the user, the remote analysis system 2 instructs the primary user-wearable device 1 to connect to the secondary user-wearable device 6, and instructs the secondary user-wearable device 6 to begin streaming motion data from the sensors of the secondary user-wearable device 6 to the primary user-wearable device 1 for sending to the remote analysis system 2. Alternatively, the remote analysis system 2 may instruct the secondary user-wearable device 6 to stream motion data directly to the remote analysis system 2 over an Internet connection.

The primary user-wearable device 1 will receive and pass telemetry from the secondary user-wearable device 6 to the remote analysis system 2 including details of its battery health and charge and so it can utilize its user interface the next morning to remind the user to charge secondary user-wearable device 6 soon when needed, for example, once its battery has reached a certain capacity (e.g., 30% capacity). The secondary user-wearable device 6 will flash a notification LED or similar signal to the user. The secondary user-wearable device 6 may also be configured to be charged on the Qi charging pad in the same way as the primary device.

In order to regain a stream of motion data relating to the user, the remote analysis system 2 instructs the primary user-wearable device 1 to remind the user to wear a secondary user-wearable device 6 for continued Fall Protection while it is being charged.

The Remote analysis system 2 may send a message to a carer if the battery charge of the primary user-wearable device 1 drops further without it being charged.

Fall Detection and User Interaction

Similar to the steps described with respect to FIGS. 1-3, on an Interesting Event (IE) determination by the remote analysis system 2, the secondary user-wearable device 6 will interact with the user in a similar fashion to primary user-wearable device 1. Secondary user-wearable device 6 or primary user-wearable device 1 will buffer the last 10-30 seconds of high resolution sensor data as a second data set to send to the remote analysis system 2 on request for high resolution analysis.

The user will have the option of cancelling a Fall Detection by gestural sensing. Carers will be notified of a fall event of the user by the remote analysis system 2 as previously with primary user-wearable device 1.

Once carers have been notified of a probable Fall their messaged replies will be spoken by secondary user-wearable device 6 to the user. The remote analysis system 2 will send the messages and audio directly to the secondary user-wearable device 6 or via the primary user-wearable device 1 device.

In a hard of hearing scenario, slaved text/graphics display (s) can also be employed, either as part of a Smart Home infrastructure (e.g. Smart TV(s)) or as separate LCD display (s) mounted on or embedded in a wall in the area(s) frequented by the user at night (e.g Bedroom/Bathroom).

These would display the carer's response messages in large text so the user could read them while waiting for assistance, reducing their anxiety and suffering. This messaging could be implemented by, for example, broadcast over the local network or be an information feed from the remote analysis system 2.

Control of Primary and Secondary User-Wearable Devices by the Remote Analysis System In the examples described above, the remote analysis system 2 controls the operation of the primary and secondary user-wearable devices by sending commands and requests to the wearable-devices. The remote analysis system 2 may also control further devices and further functionality of the primary and secondary user-wearable devices. Below is a summary of control functions of the remote analysis system 2.

Sensor Control and Real-Time Data Acquisition

The remote analysis system 2 initiates device sensor capture from a given user-wearable device by sending a command to the device to begin sensor data capture. Furthermore, the remote analysis system 2 may also request that stored data is sent from the user-wearable device based on the received data. In particular, the remote analysis system 2 may request a second high-resolution data set when the remote analysis system 2 considers that an Interesting Event (IE) (i.e. a possible fall) has occurred from its observations and analysis of the data stream (as described above).

The remote analysis system 2 may set up calibration and sensor acquisition parameters on-device based on its observations of the User/Environment.

Wearable Device UX

The remote analysis system 2 sends commands to control UX components of the primary 1 or secondary 6 user-wearable devices, e.g. display, haptic buzzer, speaker and microphone, lights, and beacon/torch LED(s) in order to facilitate communication with the user (or other people nearby).

In some examples, the remote analysis system 2 may initiate processes in the primary 1 or secondary 6 user-wearable devices for acquiring the user's attention through info/alert tones, vibrating haptics, flashing lights.

In some examples, the remote analysis system 2 may command the primary 1 or secondary 6 user-wearable devices to initiate recognition of the user's destures via Infra-red or visual sensors or macro-scale physical gestures while holding primary 1 or secondary 6 user-wearable devices.

In some examples, the remote analysis system 2 may command the primary 1 or secondary 6 user-wearable devices to display informational and carers' messages on the device's display.

In some examples, the remote analysis system 2 may command the primary 1 or secondary 6 user-wearable devices to may convert the textual informational and carer messages into spoken speech audio data, (for example in WAV or MP3 format). This speech audio data is then sent or streamed to the device, so that the message may be played/spoken from device's speaker.

In some examples, the user will have a preferred communication language registered as a preference with the remote analysis system 2. The remote analysis system 2 may translate carer messages into the user's preferred language to send to the primary or secondary user-wearable device. For example, an elderly user who speaks and understands Hindi may have carers who are English speaking. When a carer responds to a fall event notification from the remote analysis system 2—in English—the remote analysis system 2 will translate the carer's response into Hindi and send it to the user's device to be displayed and spoken in Hindi.

Controlling IOT Devices

The remote analysis system 2 may interface with home devices in a Smart Home to assist the user according to the user's home environmental situation.

For example, the remote analysis system 2 may adjust lighting in the home when a fall has occurred in darkness by sending a command message to an internet enabled light controller 601, either via the primary user-wearable control device 1 or directly to the internet enabled light controller 601. The internet enabled light controller 601 is configured to adjust the lighting level of a light element 602.

The remote analysis system 2 may activate and display messages on internet-enabled Smart TVs 603 in the Home by sending a message to the internet enabled Smart TV 603, either via the primary user-wearable control device 1 or directly to the internet enabled Smart TV.

The remote analysis system 2 may also display messages on internet-enabled displays 604 embedded in wall of the room that wearer is occupying. For example, internet-enabled displays 604 may be mounted on a wall so that wearer can see them from anywhere in the room. The display 604 may, for example be mounted in room, where many falls occur, such a bathroom. The display 604 may be disposed on or in place of a tile. The display 604 may be used to relay carer messages and status updates on command of the remote analysis system 2. Such displays 604 may be configured to provide extra large-format information in the local environment to provide message delivery coverage in case the user-wearable device's small display is not reachable.

The remote analysis system 2 may send a command to an internet enabled security system of a house in order to unlock home doors after authenticating with an arriving carer to allow access in the event of a fall.

Interfacing with 3rd Party Services

The remote analysis system 2 can interface with 3rd Party Services offering API access and control.

For example, the remote analysis system 2 may employ 3rd Party telecoms API services to communicate with Carers (and other interested parties) using legacy, universal SMS/Text communication, as described above.

The remote analysis system 2 may also interface with carers' preferred modern, private encrypted messaging services to communicate with carers on their mobile devices.

The following numbered clauses describe embodiments of the invention.

Clause 1. A user mobility monitoring system comprising:

a user-wearable device for monitoring the physical mobility of a user, the user-wearable device having a plurality of sensors, including at least motion sensors, the device being wirelessly connectable to the Internet and adapted in use to transmit wirelessly to the Internet real-time sensor data from the sensors for the duration of a monitoring period; and, a remote analysis system connectable to the Internet and adapted in use to receive the sensor data transmitted via the Internet from the user-wearable device and, during the monitoring period, to analyse the data so as to detect a physical instability event of the user and generate corresponding alert data.

Clause 2. A user mobility monitoring system according to clause 1, wherein the user-wearable device includes a sensor subsystem comprising the plurality of sensors and wherein the plurality of sensors include motion, position and environmental sensors.

Clause 3. A user mobility monitoring system according to clause 2, wherein the sensors include one or more types of sensors selected from the list of: accelerometers, gyroscopic sensors, barometric sensors, light sensors and temperature sensors.

Clause 4. A user mobility monitoring system according to any of the preceding clauses, wherein the user-wearable device comprises a user interaction subsystem having one or more devices selected from the list of: a display, a buzzer, a haptic transducer, a touch controller.

Clause 5. A user mobility monitoring system according to any of the preceding clauses, wherein the user-wearable device comprises a sound subsystem including a speaker which generates a sufficiently low level of electromagnetic radiation to have substantially no effect upon the sensors.

Clause 6. A user mobility monitoring system according to any of the preceding clauses, wherein the user-wearable device comprises a power subsystem comprising a rechargeable battery and an inductive coupling charger.

Clause 7. A user mobility monitoring system according to any of the preceding clauses, wherein the user-wearable device comprises a communication and application subsystem adapted to provide direct communication using the Wi-Fi protocol to an Internet-connected router.

Clause 8. A user mobility monitoring system according to clause 7, wherein the communication and application subsystem is effected using a system on chip or system on module design with integrated application processor and Wi-Fi hardware.

Clause 9. A user mobility monitoring system according to any of the preceding clauses, wherein the remote analysis system is effected using one or more cloud computing service models.

Clause 10. A user mobility monitoring system according to any of the preceding clauses, wherein the remote analysis system continuously analyses the sensor data which is streamed from the user-wearable device during the monitoring period.

Clause 11. A user mobility monitoring system according to any of the preceding clauses, wherein the analysis is performed by the remote analysis system by processing the sensor data with one or more artificial intelligence algorithms.

Clause 12. A user mobility monitoring system according to any of the preceding clauses, wherein the user-wearable device is adapted such that the said real-time sensor data is transmitted as a first data set and wherein a second data set, corresponding to the first data set, is stored locally on the user-wearable device and is transmitted to the analysis system as a result of a request received from the analysis system.

Clause 13. A user mobility monitoring system according to clause 12, wherein the second data set comprises one or each of, data at a greater time sampling rate than that of the first data set, or data from additional sensors to that present in the first data set.

Clause 14. A user mobility monitoring system according to clause 12 or clause 13, wherein the second data set represents data obtained during a part of the monitoring period.

Clause 15. A user mobility monitoring system according to any of clauses 12 to 14, wherein the remote analysis system is adapted to process the first data set and, upon detection of a provisional physical instability event, request the second data set from the device and further process the second data set so as to confirm whether the provisional physical instability event is a physical instability event.

Clause 16. A user mobility monitoring system according to any of clauses 12 to 15, wherein the monitoring of the first data set is performed by a stream processing subsystem and wherein, when the monitoring is performed upon the first data set and the monitoring provisionally indicates that an instability event has occurred, then the remote analysis system sends a request to the user-wearable device to transmit the second data set representative of the part of the monitoring period for which the provisional indication has occurred, to the remote analysis system, and wherein the remote analysis system further comprises a machine reasoning subsystem which then analyses the second data set to monitor whether a user instability even has occurred and, if such an event has occurred then the alert data is generated.

Clause 17. A user mobility monitoring system according to any of the preceding clauses, wherein the remote analysis system comprises a machine learning subsystem which analyses previously obtained sensor data from the user representing previous mobility activity of the user over a historical period, and wherein the remote analysis system uses the results of the analysis by the machine learning subsystem in the monitoring for user instability events.

Clause 18. A user mobility monitoring system according to any of the preceding clauses, wherein the remote analysis system is further adapted to store the sensor data and to analyse the sensor data representing the mobility activity of the user which has occurred during a trend period at least greater than the monitoring period so as to generate trend data representing trends in the mobility activity of the user.

Clause 19. A user mobility monitoring system according to any of the preceding clauses, wherein the remote analysis system further comprises a communications hub which is adapted to communicate an alert message to one or more recipients in response to the alert data being generated.

Clause 20. A user mobility monitoring system according to any of the preceding clauses, wherein the remote analysis system is further adapted to receive a textual message from a predefined source, to convert the textual message into a voice data file and then transmit the voice data file to the user-wearable device for audible transmission to the user.

Clause 21. A user mobility monitoring system according to any of the preceding clauses, further comprising a computer-implemented dashboard adapted to provide information about the user to a carer.

Clause 22. A remote analysis system for use in a user mobility monitoring system according to any of clauses 1 to 21, wherein the remote analysis system is computer-implemented on one or more processors at a location remote from that of the user-wearable device and is further adapted to communicate via the Internet with the user-wearable device of the user mobility monitoring system.

Clause 23. A user-wearable device for use in a user mobility monitoring system according to any of clauses 1 to 22, the user-wearable device being adapted to communicate via the Internet with the remote analysis system of the user mobility monitoring system.

The invention claimed is:

1. A user mobility monitoring system comprising:

first and second user-wearable devices each for monitoring the physical mobility of a user, the first and second user-wearable devices having a plurality of sensors, including at least motion sensors, the first and second user-wearable devices each being wirelessly connectable directly to the Internet and adapted in use to transmit wirelessly to the Internet and in real-time raw physical mobility data from the sensors for the duration of first and second monitoring periods, respectively; and a remote analysis system connectable directly to the Internet and adapted in use to receive the raw physical mobility data transmitted via the Internet from the first and second user-wearable devices and, during the first and second monitoring periods, respectively, to analyse the raw physical mobility data so as to detect a physical instability event of the user and generate corresponding alert data;

wherein the operations of the first and second user-wearable devices are controlled at least party by the remote analysis system; and wherein, in response to the remote analysis system detecting that the first user-wearable device is no longer able to detect motion of the user and that the secondary user-wearable device is able to detect motion of the user, the remote analysis system commands the first user-wearable device to cease transmitting in real-time the raw physical mobility data to the remote analysis system, and the remote analysis system commands the secondary user-wearable device to begin transmitting in real-time the raw physical mobility data to the remote analysis system.

2. The user mobility monitoring system of claim 1, wherein the remote analysis system continuously analyzes the raw physical mobility data from the first and second user-wearable devices during the first and second monitoring periods.

3. The user mobility monitoring system of claim 1, wherein the analysis is performed by the remote analysis system by processing the raw physical mobility data with one or more artificial intelligence algorithms.

4. The user mobility monitoring system of claim 1, wherein at least one of the first and second user-wearable devices is adapted such that the real-time raw physical mobility data is transmitted as a first data set and wherein a second data set, corresponding to the first data set, is stored locally on the user-wearable device and is transmitted to the analysis system as a result of a request received from the analysis system.

5. The user mobility monitoring system of claim 4, wherein the second data set comprises one or each of raw physical mobility data at a greater time sampling rate than that of the first data set, or raw physical mobility data from additional sensors to that present in the first data set.

6. The user mobility monitoring system of claim 4, wherein the second data set represents raw physical mobility data obtained during a part of the monitoring period.

7. The user mobility monitoring system of claim 4, wherein the remote analysis system is adapted to process the first data set and, upon detection of a provisional physical instability event, request the second data set from the device and further process the second data set so as to confirm whether the provisional physical instability event is a physical instability event.

8. The user mobility monitoring system of claim 4, wherein the monitoring of the first data set is performed by a stream processing subsystem and wherein, when the monitoring is performed upon the first data set and the monitoring provisionally indicates that an instability event has occurred, then the remote analysis system sends a request to the one of the first and second user-wearable devices to transmit the second data set representative of the part of the one of the first and second monitoring periods for which the provisional indication has occurred, to the remote analysis system, and wherein the remote analysis system further comprises a machine reasoning subsystem which then analyzes the second data set to monitor whether a user instability event has occurred and, if such an event has occurred then the alert data is generated.

9. The user mobility monitoring system of claim 1, wherein the remote analysis system comprises a machine learning subsystem that analyzes previously obtained raw physical mobility data from the user representing previous mobility activity of the user over a historical period, and wherein the remote analysis system uses the results of the analysis by the machine learning subsystem in the monitoring for user instability events.

10. The user mobility monitoring system of claim 1, wherein the remote analysis system is further adapted to store the raw physical mobility data and to analyse the raw physical mobility data representing the mobility activity of the user that has occurred during a trend period at least greater than the first and second monitoring periods so as to generate trend data representing trends in the mobility activity of the user.

11. The user mobility monitoring system of claim 1, wherein the remote analysis system further comprises a communications hub that is adapted to communicate an alert message to one or more recipients in response to the alert data being generated.

12. The user mobility monitoring system of claim 1, wherein the remote analysis system is further adapted to receive a textual message from a predefined source, to convert the textual message into a voice data file and then transmit the voice data file to the user-wearable device for audible transmission to the user.

13. The user mobility monitoring system of claim 1, further comprising a computer-implemented dashboard adapted to provide information about the user to a carer.

14. The user mobility monitoring system of claim 1, wherein the remote analysis system is effected using one or more cloud computing service models.

15. A method of monitoring the mobility of a user who is wearing first and second internet accessible user-wearable devices having a plurality of sensors, including at least motion sensors, the first and second internet accessible user-wearable devices being wirelessly connected to an internet accessible remote analysis system directly via the Internet, the method comprising:

collecting raw physical mobility data for the user via the plurality of sensors;

transmitting the raw physical mobility data from the first and second user-wearable devices, in real-time, to the remote analysis system directly via the Internet, for the duration of first and second monitoring periods, respectively;

receiving the transmitted raw physical mobility data at the remote analysis system;

analyzing the transmitted raw physical mobility data at the remote analysis system so as to detect a physical instability event of the user;

generating alert data by the remote analysis system if a physical instability event of the user is detected;

controlling operation of at least one of the user-wearable devices at least partly by the remote analysis system; and wherein, in response to the remote analysis system detecting that the first user-wearable device is no longer able to detect motion of the user and that the secondary user-wearable device is able to detect motion of the user, the remote analysis system commands the first user-wearable device to cease transmitting in real-time the raw physical mobility data to the remote analysis system, and the remote analysis system commands the secondary user-wearable device to begin transmitting in real-time the raw physical mobility data to the remote analysis system.

16. The method of claim 15, wherein the raw physical mobility data is transmitted as a first data set and wherein, when a physical instability event is detected by the remote analysis system the corresponding one of the first and second user-wearable devices is controlled by the remote analysis system to transmit a second data set of raw physical mobility, corresponding to the first data set and stored locally on the corresponding one of the first and second user-wearable devices, to the remote analysis system, and wherein the second data set has a greater time sampling rate than the first data set.

* * * * *